US007070662B2

(12) United States Patent
Studebaker

(10) Patent No.: US 7,070,662 B2
(45) Date of Patent: Jul. 4, 2006

(54) SPRAYLESS SURFACE CLEANER

(76) Inventor: Roy Studebaker, 21648 Oregon Trail Rd., Centralia, Lewis County, WA (US) 98531

( * ) Notice: Subject to any disclaimer, the term of this patent is extended or adjusted under 35 U.S.C. 154(b) by 83 days.

(21) Appl. No.: 10/778,887

(22) Filed: Feb. 13, 2004

(65) Prior Publication Data

US 2005/0177972 A1 Aug. 18, 2005

(51) Int. Cl.
*B08B 5/04* (2006.01)
*A47L 11/30* (2006.01)

(52) U.S. Cl. ..... 134/21; 15/322; 15/385

(58) Field of Classification Search ..... 15/302, 15/309.1, 309.2, 320–322, 345, 346, 385; 134/21

See application file for complete search history.

(56) References Cited

U.S. PATENT DOCUMENTS 3,841,910 A * 10/1974 Baker ..... 134/15
4,095,309 A * 6/1978 Sundheim ..... 15/320
4,120,070 A * 10/1978 Severin ..... 15/309.2
4,161,802 A * 7/1979 Knight et al. ..... 15/331
4,166,368 A * 9/1979 Beninca' et al. ..... 68/20
4,400,846 A * 8/1983 Sanderson ..... 15/309.1
5,613,271 A * 3/1997 Thomas ..... 15/321
6,151,748 A * 11/2000 Earhart et al. ..... 15/321
6,192,547 B1 * 2/2001 Song ..... 15/308
6,243,914 B1 * 6/2001 Studebaker ..... 15/322

FOREIGN PATENT DOCUMENTS

FR 2601239 * 7/1986
FR 002601239 A 1/1988
JP 1-256920 * 10/1989
JP 1256920 10/1989
JP 4-261629 * 9/1992
JP 4261629 9/1992
WO WO 9935953 7/1999

* cited by examiner

*Primary Examiner*—Terrence R. Till
(74) *Attorney, Agent, or Firm*—Charles J. Rupnick

(57) ABSTRACT

A bar jet assembly formed of a base plate having a cleaning fluid discharge chamber communicating with a cleaning fluid input surface and a discharge slot in a cleaning fluid output surface; and a pair of cover plates coupled to the fluid output surface of the base plate and forming therebetween an inclined cleaning fluid discharge orifice communicating with the base plate discharge slot.

62 Claims, 9 Drawing Sheets

SPRAYLESS SURFACE CLEANER

FIELD OF THE INVENTION

The present invention to a tool for cleaning surfaces, and in particular to an apparatus and method of delivering cleaning fluid for cleaning flooring surfaces, wall surfaces and upholstery.

BACKGROUND OF THE INVENTION

Many apparatuses and methods are known for cleaning carpeting and other flooring, wall and upholstery surfaces. The cleaning apparatuses and methods most commonly used today apply cleaning fluid as a spray under pressure to the surface whereupon the cleaning fluid dissolves the dirt and stains and the apparatus scrubs the fibers while simultaneously applying a vacuum or negative pressure to extract the cleaning fluid and the dissolved soil. Although such relatively high pressure methods are the most commonly used, they have disadvantages. First, the majority of the soil is at or near the surface of the fibers so that high pressure cleaning tends to drive some of the surface soil and cleaning fluid deeper, whereby a very powerful vacuum system is required to extract particles that have been driven beneath the outermost surface. Furthermore, the use of cleaning fluid under pressure, applied as a spray through conventional jets, drives the fluid itself deeper, and the fluid that is not immediately removed by the vacuum source requires a significantly longer drying period. While longer drying time is an inconvenience, if the carpeting is used prior to its being completely dry, it is more likely to become soiled. Additionally, conventional jets atomize the sprayed fluid which then comes into contact with the air, causing significant heat loss and diminishing the cleaning power of the fluid.

Many different apparatuses and methods for spraying cleaning fluid under pressure and then removing it with a vacuum are illustrated in the prior art supplied herewith but will not be discussed in detail.

Another category of carpeting and upholstery cleaning apparatuses and methods use a rotating device wherein the entire machine is transported over the carpeting while a cleaning head is rotated about a vertical axis. Typically, these machines include a plurality of arms, each of having one or more spray nozzles or a vacuum source providing a more intense scrubbing action since, in general, more scrubbing surfaces contact the carpet. These apparatuses and methods are primarily illustrated in U.S. Pat. No. 4,441,229 granted to Monson on Apr. 10, 1984, and are listed in the prior art known to the inventor but not discussed in detail herein.

A third category of carpeting and upholstery cleaning apparatuses and methods that attempt to deflect or otherwise control the cleaning fluid are illustrated by U.S. Pat. No. 4,137,600 granted to Albishausen on Feb. 6, 1970, which discloses a cleaning apparatus wherein the cleaning fluid is changed into a liquid curtain by a baffle within the cleaning head; U.S. Pat. No. 4,335,486 granted to Kochte on Jan. 22, 1982, which discloses a surface cleaning machine wherein the cleaning fluid is deposited upon the surface of the carpet pile from a wick like device wetted with the cleaning fluid; U.S. Pat. No. 4,649,594 granted to Grave on Mar. 17, 1987, which discloses a cleaning head wherein the cleaning solution is sprayed through a narrow passage and some is wicked along the surface of the passage; U.S. Pat. No. 5,157,805 granted to Pinter on Oct. 27, 1992, which discloses a method and apparatus for cleaning a carpet wherein the cleaning fluid is sprayed by nozzle against the back of a striker plate and then flows downwardly and through the carpet to a pickup vacuum; and U.S. Pat. No. 5,561,884 granted to Nijland et al on Oct. 8, 1996, which discloses a suction attachment spray member wherein the fluid is sprayed against a distributor plate that creates a planar diverging liquid jet substantially filling the vacuum chamber.

U.S. Pat. No. 6,243,914, which was granted Jun. 12, 2001, to the inventor of the present patent application and which is incorporated herein by reference, discloses a cleaning head for carpets, walls or upholstery, having a rigid open-bottomed main body that defines a surface subjected to the cleaning process. Mounted within or adjacent to the main body and coplanar with the bottom thereof is a fluid-applying device which includes a slot at an acute angle to the plane of the bottom of the body located adjacent the plane of the bottom of the body, the slot configured such that the fluid is applied in a thin sheet that flows out of the slot and into the upper portion of the surface to be cleaned and subsequently into the vacuum source for recovery. The cleaning head is alternatively multiply embodied in a plurality of arms which are rotated about a hub.

FIG. 1 is a cross-sectional view that illustrates one of four separate embodiments of the cleaning head disclosed in U.S. Pat. No. 6,243,914 wherein the cleaning head 1 for applying cleaning fluid without the inherent problems of spray either escaping or unduly penetrating the carpeting. Front and back surfaces 3, 5 of the cleaning head 1 combine with opposing end panels (not shown) to define a rectangular lip 7 which defines a surface contact area of the surface to be cleaned, which is momentarily subjected to the cleaning environment generated by the cleaning head 1. Securely mounted to an interior portion of the cleaning head 1 is a downwardly open fluid supply chamber 9 formed between a first wall 11 terminating in a head surface 13 and a second wall 15 terminating in an inwardly turned foot 17. The fluid supply chamber 9 terminates in an angled slot or groove 19 adjacent to the head surface 13 and oriented at an obtuse angle thereto, i.e., an acute angle to the surface to be cleaned. Walls 21 and 23 combine with opposing end panels (not shown) to form a vacuum chamber 25 that is spaced away from the fluid supply chamber 9 by the width of the head surface 13.

As disclosed in U.S. Pat. No. 6,243,914, cleaning fluid is supplied in a steady stream downwardly through the fluid supply chamber 9 between the walls 11 and 15 and flows outwardly through the angled slot 19 past the foot 17 and is drawn in a sheet across the head surface 13 by a vacuum formed in the vacuum chamber 25, whereby it is applied uniformly to the carpeting or other surface to be cleaned. The fluid is removed from the cleaned surface by vacuum in the vacuum chamber 25. The utilization of a sheet of fluid which flows down the fluid supply chamber 9 and across the head surface 13 eliminates the cooling of the fluid that results from atomizing caused by prior art spray nozzles. The utilization of a sheet of fluid also reduces the amount of fluid being used for a given cleaning job, and eliminates over spray of the cleaning fluid should the cleaning head 1 be inadvertently moved from the surface to be cleaned or tilted so one edge is raised.

The present invention provides improvements to the cleaning head disclosed in U.S. Pat. No. 6,243,914.

SUMMARY OF THE INVENTION

The present invention provides novel improvements on the cleaning head disclosed in U.S. Pat. No. 6,243,914.

Accordingly, the present invention provides an improved apparatus and method for spraylessly delivering cleaning fluid for cleaning flooring surfaces, wall surfaces and upholstery.

According to one aspect of the invention, the apparatus and method of the invention is embodied in a novel three-part bar jet assembly formed of: a substantially flat base plate having spaced apart and substantially parallel planar cleaning fluid input and output surfaces and an elongated cleaning fluid discharge chamber formed therein in communication with both the input and output surfaces, the discharge chamber having a relatively long and wide mouth or opening in communication with the fluid input surface and terminating adjacent to one side of the chamber in a relatively shorter and narrower discharge slot that is in communication with the fluid output surface; a forward or leading cover plate having spaced apart and substantially parallel planar mounting and cleaning fluid output surfaces that are interconnected along one edge by a substantially planar cleaning fluid retrieval slot surface that is oriented to form a right angle with both the mounting and output surfaces and along an opposite edge by a substantially planar discharge slot leading surface that is optionally oriented to form an obtuse angle to the leading cover plate output surface, the mounting surface of the leading cover plate is securely fixed to the output surface of the base plate with the discharge slot leading surface adjacent to and substantially contiguous with an edge of the base plate discharge slot opposite from the discharge chamber of the base plate and the retrieval slot surface adjacent to and substantially contiguous with a substantially planar right-angled peripheral edge surface of the base plate; and an aft or following cover plate having spaced apart and substantially parallel planar mounting and cleaning fluid output surfaces that are interconnected along one edge by a substantially planar discharge slot following: surface that is optionally oriented to form an acute angle to the following cover plate output surface, the mounting surface of the following cover plate is securely fixed to the output surface of the base plate with the discharge slot following surface adjacent to and substantially contiguous with an edge of the base plate discharge slot opposite from the leading cover plate and spaced away from the discharge slot leading surface, whereby the spaced apart discharge slot leading and following surfaces form therebetween a narrow cleaning fluid discharge slot oriented at an acute angle to the cleaning fluid output surfaces of the leading and following cover plates.

According to another aspect of the invention, the invention is embodied in a cleaning head having the bar jet assembly of the invention being coupled to a nozzle, the nozzle being structured for coupling a source of pressurized cleaning fluid to the bar jet assembly cleaning fluid discharge chamber, and being further structured for coupling a vacuum source in communication with the bar jet assembly cleaning fluid retrieval slot surface.

According to another aspect of the invention, the cleaning head is a rotary cleaning head that is structured to be rotated by a motor, by example and without limitation, either directly or via a gear or belt drive.

According to another aspect of the invention, the present invention provides a method for cleaning a surface.

BRIEF DESCRIPTION OF THE DRAWINGS

Figure 27:
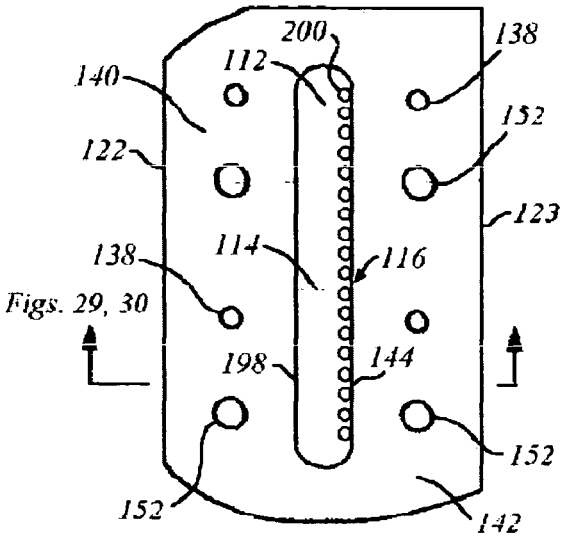

The foregoing aspects and many of the attendant advantages of this invention will become more readily appreciated as the same becomes better understood by reference to the following detailed description, when taken in conjunction with the accompanying drawings, wherein:

FIGS. 6, 7, 8 and 9 illustrate one embodiment of the bar jet assembly of the invention, wherein FIG. 6 is a top plan view looking at a cleaning fluid input face of the bar jet assembly, FIG. 7 is an end view taken from FIG. 6, FIG. 8 is a cross-sectional view taken through the top plan view of FIG. 6, and FIG. 9 is a bottom plan view looking at the operational cleaning face of the bar jet assembly of the invention;

FIGS. 18, 19 and 20 illustrate one alternative embodiment of the bar jet assembly of the invention, wherein FIG. 18 is a top plan view looking at the cleaning fluid input face of the alternative bar jet assembly, FIG. 19 is a bottom plan view looking at the operational cleaning face of the alternative bar jet assembly, and FIG. 19 is a cross-sectional view of the alternative bar jet assembly taken through the top plan view of FIG. 18;

FIGS. 23, 24, 25 and 26 illustrate another alternative embodiment of the bar jet assembly of the invention, wherein FIG. 23 is a top plan view looking at the cleaning fluid input face of the alternative bar jet assembly, FIG. 24 is a bottom plan view looking at the operational cleaning face of the alternative bar jet assembly, and FIGS. 25 and 26 are alternative cross-sectional views of the alternative bar jet assembly taken through the top plan view of FIG. 23; and FIGS. 27, 28, 29 and 30 illustrate another alternative embodiment of the bar jet assembly of the invention, wherein FIG. 27 is a top plan view looking at the cleaning fluid input face of the alternative bar jet assembly, FIG. 28 is a bottom plan view looking at the operational cleaning face of the alternative bar jet assembly, and FIGS. 29 and 30 are alternative cross-sectional views of the alternative bar jet assembly taken through the top plan view of FIG. 27.

DETAILED DESCRIPTION OF PREFERRED EMBODIMENT

In the Figures, like numerals indicate like elements.

The present invention is an apparatus and method for spraylessly delivering cleaning fluid for cleaning flooring surfaces, wall surfaces and upholstery. The apparatus and method of the invention being embodied, by example and without limitation, in a novel three-part bar jet assembly formed of: a substantially flat base plate having spaced apart and substantially parallel planar cleaning fluid input and output surfaces and having an elongated cleaning fluid discharge chamber formed therein in communication with both the input and output surfaces, the discharge chamber having a relatively long and wide mouth or opening in communication with the fluid input surface and terminating adjacent to one side of the chamber in a relatively shorter and narrower discharge slot that is in communication with the fluid output surface; a forward or leading cover plate having spaced apart and substantially parallel planar mounting and cleaning fluid output surfaces that are interconnected along one edge by a substantially planar cleaning fluid retrieval slot surface that is oriented to form a right angle with both the mounting and output surfaces and along an opposite edge by a substantially planar discharge orifice leading surface that is optionally oriented to form an obtuse angle to the leading cover plate output surface, the mounting surface of the leading cover plate is securely fixed to the output surface of the base plate with the discharge orifice leading surface adjacent to and substantially contiguous with an edge of the base plate discharge orifice opposite from the discharge chamber of the base plate and the retrieval slot surface adjacent to and substantially contiguous with a substantially planar right-angled peripheral edge surface of the base plate; and an aft or following cover plate having spaced apart and substantially parallel planar mounting and cleaning fluid output surfaces that are interconnected along one edge by a substantially planar discharge orifice following surface that is optionally oriented to form the same acute angle to the following cover plate output surface, the mounting surface of the following cover plate is securely fixed to the output surface of the base plate with the discharge orifice following surface adjacent to and substantially contiguous with an edge of the base plate discharge slot opposite from the leading cover plate and spaced away from the discharge orifice leading surface, whereby the spaced apart discharge orifice leading and following surfaces form therebetween a narrow and elongated cleaning fluid discharge slot oriented at an acute angle to the cleaning fluid output surfaces of the leading and following cover plates.

According to one embodiment of the invention, the acute angle formed by the narrow cleaning fluid discharge slot relative to the cleaning fluid output surfaces of the leading and following cover plates is on the order of 45 degrees or less. Furthermore, the discharge orifice leading and following surfaces are spaced apart by 0.020 inches or less to form the narrow and elongated cleaning fluid discharge slot.

According to one embodiment of the invention, the cleaning fluid discharge chamber is formed in the base plate having a striker plate adjacent to the discharge slot. By example and without limitation, the striker plate is embodied as a substantially planar surface having one elongated edge that intersects the cleaning fluid input surface of the base plate and a second elongated edge that intersects one side of the discharge slot adjacent to the fluid output surface. An elongated upright wall portion of the fluid discharge chamber is formed between the cleaning fluid input surface of the base plate and the other side of the discharge slot opposite from the striker plate. According to one embodiment of the invention, the upright wall is oriented substantially at a right angle to the cleaning fluid input surface of the base plate, whereby the fluid discharge chamber is embodied in an elongated right triangular chamber having the upright right-angle wall between the base plate input and output surfaces on one side of the discharge slot, and the angled striker plate inclined between the base plate input and output surfaces on the other side of the discharge slot opposite from the upright right-angle wall.

According to one embodiment of the invention, the discharge slot in the base plate is embodied in an elongated throat situated between the upright right-angle wall and the inclined striker plate surface, and communicating between the discharge chamber and the output surface of the base plate.

According to one embodiment of the invention, the novel bar jet assembly of the invention is coupled to a cleaning surface of a rotary cleaning plate having a cleaning fluid and soil retrieval slot machined therethrough and being coupled to a vacuum source, the right-angled peripheral edge surface of the base plate and the retrieval slot surface of the leading cover plate both being positioned adjacent to and substantially contiguous with the retrieval slot machined in the rotary cleaning plate. Additionally, the relatively long and wide input opening of the discharge chamber is coupled through the rotary cleaning plate to a source of pressurized cleaning fluid. According to one embodiment of the invention, the discharge chamber is coupled to a cleaning fluid distribution manifold that is further structured to operate as an expansion chamber for reducing the pressure of the cleaning fluid to below a delivery pressure provided by the source of pressurized cleaning fluid.

According to one embodiment of the invention, the rotary cleaning plate includes a plurality of the cleaning fluid and soil retrieval slots machined therethrough and being coupled to the same or another vacuum source, and including a plurality of the novel bar jet assemblies with one of the bar jet assemblies being coupled to the rotary cleaning plate adjacent to each of the cleaning fluid and soil retrieval slots. By example and without limitation, three of the cleaning fluid and soil retrieval slots and bar jet assemblies combinations are provided. According to one embodiment of the invention, a plurality of stabilizing members is distributed across the cleaning surface of the rotary cleaning plate with at least one of the stabilizer members positioned midway between each pair of the bar jet assemblies, whereby the cleaning surface of the rotary cleaning plate is maintained at a substantially constant and uniform height above or away from the carpeting or other surface to be cleaned.

According to one embodiment of the invention, cleaning fluid distribution manifold includes a centrally located input sprue hole and expansion chamber coupled to a network of cleaning fluid distribution channels of combined area sufficiently enlarged relative to a cleaning fluid delivery tube as to significantly reduce the delivery pressure of the cleaning fluid at the input sprue hole to the expansion chamber.

Figure 1:
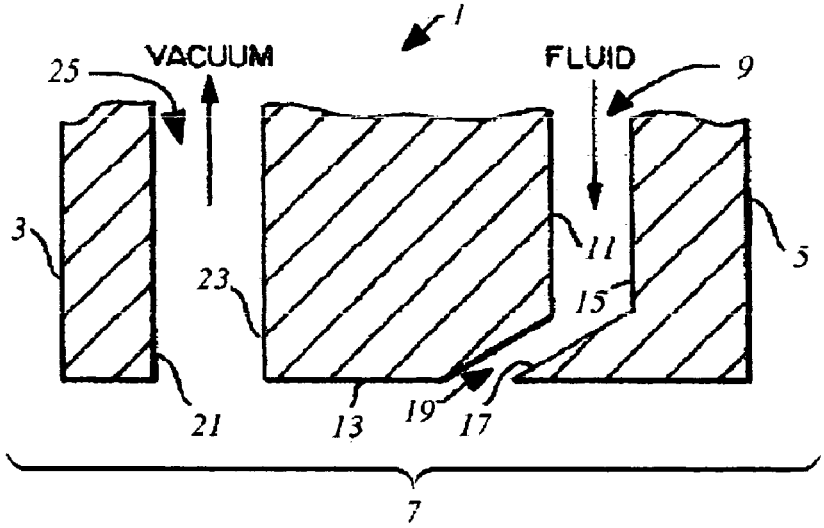
Fig. 1 (Prior Art)
FIG. 1 is a cross-sectional view that illustrates one of four separate embodiments of the cleaning head disclosed in U.S. Pat. No. 6,243,914.
Figure 2:
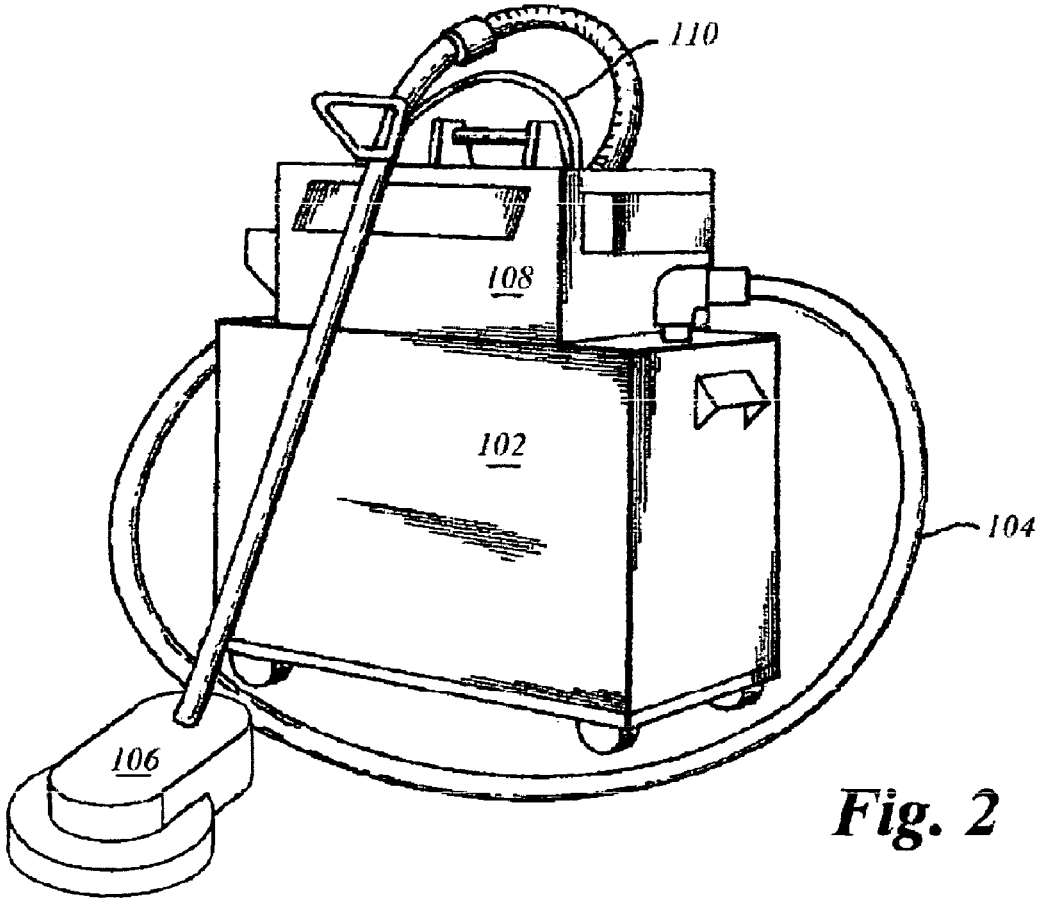
FIG. 2 is an exemplary illustration of a cleaning system useful for operating the improved cleaning head of the present invention.

Accordingly, FIG. 2 is an exemplary illustration of a cleaning system 100 useful for operating the improved cleaning head of the present invention. The cleaning system 100 is, for example, embodied in a main waste receptacle 102 into which soiled fluid is returned via a vacuum hose 104 interconnected with the cleaning head 106 of the invention. Mounted above the waste receptacle 102 is a vacuum source and supply of a pressurized liquid cleaning fluid depicted generally at 108. The liquid cleaning fluid is supplied to the cleaning head 106 via a liquid cleaning fluid delivery tube 110 coupled to the source of pressurized liquid cleaning fluid. It is to be understood that this cleaning system could be track-mounted.

Figure 4:
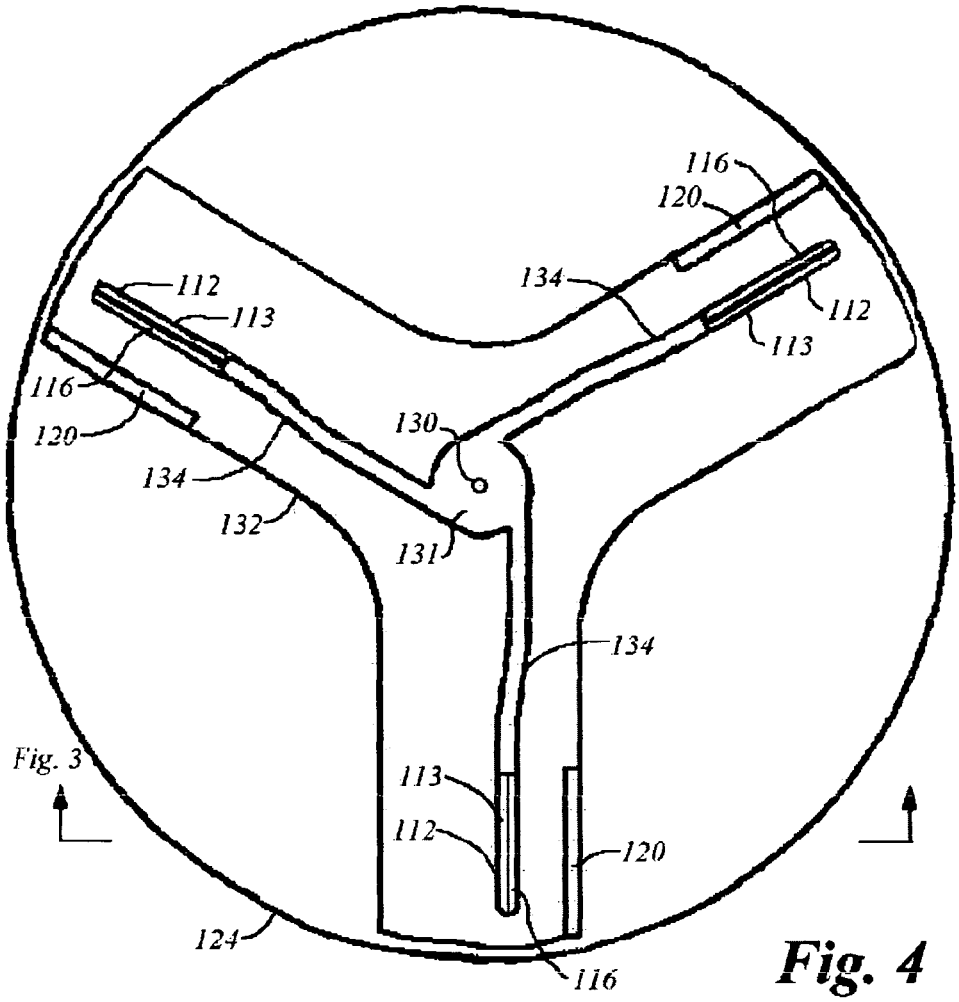
FIG. 4 is a top down or plan view of the cleaning head of the invention that illustrates the distributed flow channels of the cleaning fluid.
Figure 3:
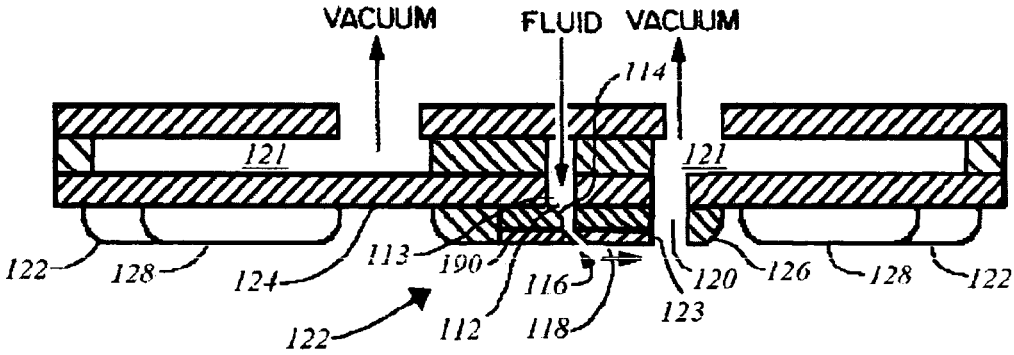
FIG. 3 is a cross-sectional view of the cleaning head of the invention taken through the plan view of FIG. 4.

FIG. 3 is a cross-sectional view of the cleaning head 106 taken through the plan view of FIG. 4. The cleaning head includes a half-funnel shaped liquid cleaning fluid discharge chamber 112 that is structured to be coupled to the cleaning system supply of cleaning fluid via a liquid cleaning fluid delivery slot 113, as discussed herein. The cleaning fluid discharge chamber 112 terminates in a parallel or an angled (shown) striker plate 114 that is adjacent to a perpendicular or an angled (shown) liquid cleaning fluid discharge slot or groove 116 opening onto one side of a cleaning head operating surface 118. Spaced away from the angled discharge orifice 116 across the expanse of the head operating surface 118 is a liquid cleaning fluid and soil retrieval slot retrieval slot or groove 120 coupled to a vacuum chamber 121 that is structured to be coupled to the cleaning system vacuum source. The cleaning fluid and soil retrieval slot 120 is formed in part by a liquid cleaning fluid retrieval slot surface 123 that is oriented crosswise to the cleaning head operating surface 118.

In operation, by means discussed in detail below, the cleaning fluid enters the discharge chamber 112 in the cleaning head 106 in a steady stream and impacts against the angled striker plate 114 adjacent to the discharge orifice 116. Impact against the angled striker plate 114 forms the cleaning fluid into a substantially uniform thin sheet that flows out of the discharge chamber 112 onto the cleaning head operating surface 118 through the angled discharge orifice 116. As indicated by the arrow, the substantially uniform thin sheet of cleaning fluid is drawn across the operating surface 118 and into the retrieval slot 120 and vacuum chamber 121 by a vacuum formed therein for delivery to the waste receptacle 102 via the vacuum hose 104.

As described in detail herein, according to the present invention, the cleaning fluid discharge chamber 112, the angled striker plate 114 and discharge slot or groove 116, and the operating surface 118 are embodied in a bar jet assembly 122 that is structured for substantially permanent attachment to a bottom cleaning surface of a substantially circular rotary cleaning plate 124 that is coupled for high speed rotary motion relative to the cleaning head 106. The bar jet assembly 122 is optionally embedded or otherwise supported by a shoe 126, shown more clearly in a subsequent Figure, that has about the same thickness as the bar jet assembly 122 and is fixed to the surface of the cleaning plate in a manner that provides a lead-in for protecting the carpeting or other surface to be cleaned from damage by impact with the leading edge of the bar jet assembly 122. Alternatively, one or more of the parts making up the bar jet assembly 122 is modified to include the lead-in feature. The rotary cleaning plate. 124 includes the retrieval slot 120 which is machined therethrough and is positioned adjacent a forward edge of the cleaning head operating surface 118 opposite from the discharge orifice 116, where the forward edge is leading when the rotary cleaning plate 124 rotates about its center in the direction that the thin sheet of cleaning fluid is drawn across the operating surface 118, as indicated by the arrow and by the rotational arrow shown in FIG. 5.

According to one embodiment of the invention and illustrated in greater detail in a subsequent Figure, the bar jet assembly 122 is repeated in a plurality of bar jet assemblies 122 distributed evenly across the bottom cleaning surface of the cleaning plate 124. Optionally, the plurality of distributed bar jet assemblies 122 are optionally interspersed with one or more stabilizers 128 also having the lead-in feature described herein. The stabilizers 128 are, by example and without limitation, formed of a slick nylon or Teflon material to better slide without sticking across the surface to be cleaned.

FIG. 4 is a top down or plan view of the cleaning head 106 of the invention that illustrates the distributed flow channels of the liquid cleaning fluid into a central sprue hole 130 and expansion chamber 131 in a liquid cleaning fluid distribution manifold 132 and thence outward along closed liquid cleaning fluid distribution channels 134, the expansion chamber 131 and cleaning fluid distribution channels 134 being of substantially greater area than an inlet which causes the distribution manifold 132 to further operate as an expansion chamber for reducing the pressure of the cleaning fluid to below the delivery pressure provided by the pressurized source 108. Optionally, another portion of the cleaning head 106 operates as the expansion chamber without limiting the scope of the invention as such devices are well-known in the art. The cleaning fluid is delivered under reduced pressure to each of the plurality of bar jet assembly 122 positioned at the outermost radial extent of the different cleaning fluid flow distribution channels 134 adjacent to the periphery of the rotary cleaning plate 124. The cleaning fluid flow distribution channels 134 are formed in communication with the cleaning fluid delivery slot 113 opening in the rotary cleaning plate 124 positioned at least adjacent to and preferably contiguous with or overlapping the cleaning fluid discharge chamber 112 of the corresponding bar jet assembly 122 such that the cleaning fluid naturally enters the discharge chamber 112 through the delivery slot 113.

Figure 5:
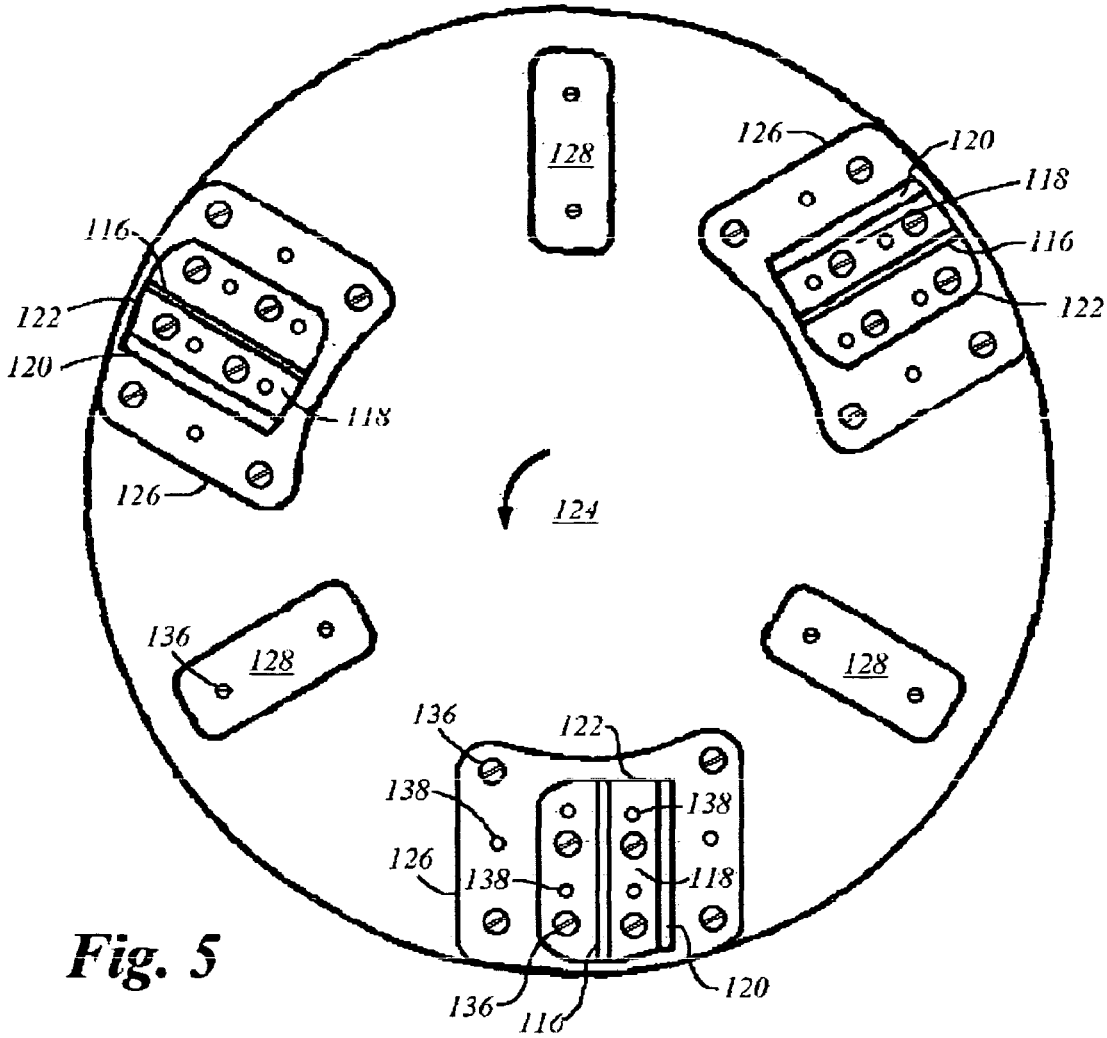
FIG. 5 is a bottom plan view of the cleaning surface of a rotary cleaning plate of the invention having a plurality of bar jet assemblies of the invention and stabilizers fixed thereto in a uniformly distributed manner.

FIG. 5 is a bottom plan view of the cleaning surface of the rotary cleaning plate 124 having a plurality of the bar jet assemblies 122 and the stabilizers 128 fixed thereto in a uniformly distributed manner with each of the bar jet assemblies 122 being embedded in one of the shoes 126. By example and without limitation, the bar jet assemblies 122 and stabilizers 128 are each fixed to the cleaning surface of the rotary cleaning plate 124 by one or more threaded fasteners 136 screwed into threaded holes in the rotary cleaning plate 124. Optionally, at least the bar jet assemblies 122 are accurately positioned relative to the corresponding cleaning fluid flow distribution channels 134 by means of the threaded fasteners 136 being embodied as flathead fasteners fitted into counter-sunk holes machined in the bar jet assemblies 122. Use of flathead fasteners in counter-sunk holes also causes the bar jet assemblies 122 to present a flush surface to the carpeting or other surface to be cleaned. The bar jet assemblies 122 present the corresponding cleaning fluid discharge and retrieval slots 116, 120 and the cleaning head operating surfaces 118 positioned therebetween.

One of the shoes 126 is fitted around each of the bar jet assemblies 122 and secured to the cleaning surface of the rotary cleaning plate 124 by one or more of the threaded fasteners 136. Optionally, the shoes 126 are additionally more accurately positioned by means of one or more locating pins 138 communicating between each of the shoes 126 and the rotary cleaning plate 124.

Figure 6:
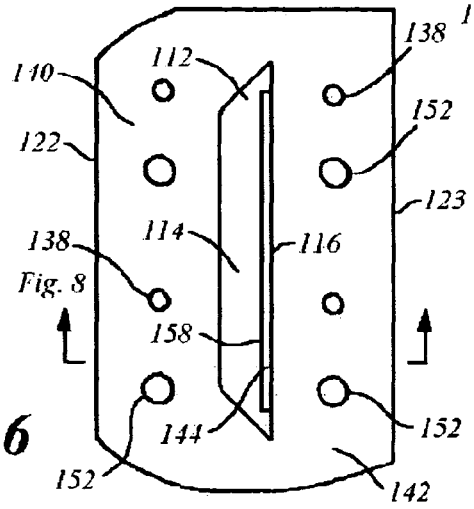
Figure 9:
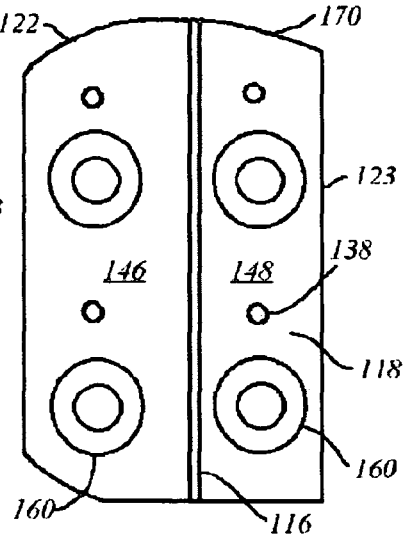
Figure 7:
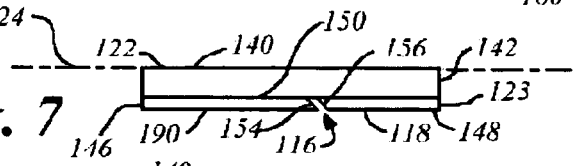
Figure 8:
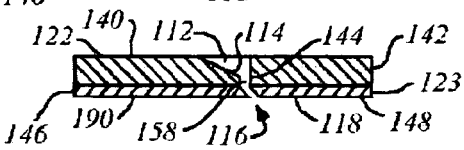

FIGS. 6, 7, 8 and 9 illustrate one embodiment of the bar jet assembly 122 of the invention, wherein FIG. 6 is a top plan view looking at a cleaning fluid input face 140 of the bar jet assembly 122, FIG. 7 is an end view taken from FIG. 6, FIG. 8 is a cross-sectional view taken through the top plan view of FIG. 6, and FIG. 9 is a bottom plan view looking at the operational cleaning face of the bar jet assembly 122. The cleaning fluid input face 140 of the bar jet assembly 122 is a planar surface embodied as a flat aluminum or aluminum alloy base plate 142, by example and without limitation of about ⅛ inch thickness, which is structured for mounting and sealing to the cleaning surface of the rotary cleaning plate 124 by one or more of the threaded fasteners 136 shown in FIG. 5. The cleaning fluid discharge chamber 112 is open and exposed for connection to the cleaning fluid distribution channel 134 of the distribution manifold 132 shown in FIG. 4. As embodied in FIG. 6, the cleaning fluid discharge chamber 112 is closed on opposite ends and includes the angled striker plate 114 leading from the fluid input face 140 to the angled discharge orifice 116 opening onto the cleaning head operating surface 118 (shown in FIGS. 7, 8, 9). An upright wall 144 of the fluid discharge chamber 112 across the angled discharge orifice 116 from the angled striker plate 114 is provided substantially perpendicular to the fluid input face 140 of the bar jet assembly 122. On either side of the cleaning fluid discharge chamber 112 one or more of the more locating pins 138 are provided for locating a pair of corrosion resistant or stainless steel cover plates 146, 148 (shown in FIGS. 7, 8, 9) of the bar jet assembly 122 relative to a cleaning fluid output surface 150 of the base plate 142 which has the cleaning fluid discharge chamber 112 formed therein. Corrosion resistant or stainless steel is used because it is tough and durable under extreme conditions and holds both an edge and a surface finish, all of which are characteristics desirable in surface cleaning equipment of the type recited here. The pins 138 are optionally press-fit in the base plate 142 and each of the cover plates 146, 148 for securing the bar jet assembly 122. Alternatively, the pins 138 are embodied as rivets for both locating the cover plates 146, 148 and for securing the bar jet assembly 122. One or more fastener through holes 152 are machined in the base plate 142 of the bar jet assembly 122 on either side of the cleaning fluid discharge chamber 112 for securing the bar jet assembly 122 to the cleaning surface of the rotary cleaning plate 124 by one or more of the threaded fasteners 136.

FIG. 7 is the end view of the bar jet assembly 122 illustrating each of the two cover plates 146, 148 secured to the base plate 142. The two cover plates 146, 148 are each machined with one of two surface 154, 156 of the angled discharge slot or groove 116 that opens onto one side of the operating surface 118. The two surfaces 154, 156 of the discharge orifice 116 each form an obtuse angle of 45 degrees or more as measured from the upright wall 144 of the fluid discharge chamber 112, i.e., an obtuse angle relative to the cleaning surface of the rotary cleaning plate 124 (shown in phantom). The angularity of the discharge orifice 116 is effective for reducing the tendency of the pressurized cleaning fluid to penetrate deep into the carpeting to be cleaned. The angle of the discharge orifice 116 causes the cleaning fluid to remain near the surface of the carpet so that the vacuum source more efficiently withdraws the cleaning fluid from the carpet nap and pulls it across the cleaning head operating surface 118. Because the cleaning fluid remains near the surface of the nap, the carpet dries very rapidly, being almost dry to the touch immediately following passage of the cleaning head 106. In contrast, a more upright or vertical discharge slot causes the cleaning fluid to be driven comparatively more deeply into the nap, and the carpet requires comparatively longer to dry. Effectiveness in reducing cleaning fluid penetration is enhanced when the discharge orifice 116 is closer to being parallel with the cleaning surface of the rotary cleaning plate 124, rather than perpendicular thereto. Therefore, according to one embodiment of the invention, the discharge orifice 116 is oriented at about 45 degrees which minimizes any tendency for the trailing edge of the slot 116 to snag on the carpeting or other surface to be cleaned.

Additionally, according to one embodiment of the invention, the two discharge slot surfaces 154, 156 are oriented at substantially the same angle relative to the upright wall 144 or the cleaning surface of the rotary cleaning plate 124, i.e., the two discharge slot surfaces 154, 156 are substantially mutually parallel. Parallelism of the discharge slot surfaces 154, 156 enhances the formation of the uniform sheet of liquid cleaning fluid. Furthermore, the two discharge slot surfaces 154, 156 are spaced only a short distance apart so that the discharge orifice 116 is very narrow which also enhances the formation of the uniform sheet of liquid cleaning fluid. According to one embodiment of the invention, the two discharge slot surfaces 154, 156 are spaced apart on the order of about 8 to 10 thousands of an inch or less such that the discharge orifice 116 is on the order of about 0.008 inch to 0.010 inch or less in width. However, the inventor has determined that widths of 0.010 inch to about 0.017 inch or even as much as 0.020 inch for the discharge orifice 116 are also effective for forming the uniform sheet of liquid cleaning fluid. The width of the discharge orifice 116 is limited to the degree that sufficient back pressure is developed in the discharge chamber 112 so that the cleaning fluid is discharge from the slot 116 under pressure, rather than flowing freely from the discharge orifice 116.

The cleaning fluid retrieval slot surface 123 is a substantially planar surface that is oriented to form a right angle with cleaning head operating surface 118.

FIG. 8 is the cross-sectional view taken through the top plan view of FIG. 6 and illustrates the fluid discharge chamber 112 being formed as a reservoir for a quantity of liquid cleaning fluid. The fluid discharge chamber 112 is of sufficient volume to equalize the fluid pressure across the entire length of the discharge orifice 116 such that a the cleaning fluid is fed to the slot 116 at a substantially uniform rate, whereby the cleaning fluid is discharged from the slot 116 in a substantially uniform sheet of liquid. The fluid discharge chamber 112 is formed of the angled striker plate 114 and the upright wall 144 and terminating in the angled discharge orifice 116. As illustrated, the striker plate 114 forms an obtuse angle of 45 degrees to 60 degrees or more as measured from the upright wall 144 of the fluid discharge chamber 112, i.e., an obtuse angle relative to the cleaning surface of the rotary cleaning plate 124 which is represented by the fluid input face 140 of the bar jet assembly 122. Effectiveness of the cleaning head 106 is enhanced when the striker plate 114 is closer to being parallel with the cleaning surface of the rotary cleaning plate 124, rather than perpendicular thereto. Thus, according to one embodiment of the invention, the striker plate 114 forms an obtuse angle of 60 to 75 degrees or more with the upright wall 144 of the fluid discharge chamber 112.

Additionally, limitations in current manufacturing processes cause a narrow throat 158 to occur at the intersection of the fluid discharge chamber 112 with the output surface 150 of the base plate 142 between the angled striker plate 114 and the upright wall 144. The throat 158 measures about the same as the width of the discharge orifice 116, but may be wider, e.g., up to about 0.008 to about 0.017 inch or even as much as 0.020 inch or more in width, and extends most of the length of the fluid discharge chamber 112. The throat 158 communicates between the fluid discharge chamber 112 of the base plate 142 and the angled discharge orifice 116. As illustrated in FIGS. 7 and 8, the leading discharge slot surface 156, which is formed in the leading cover plate 148, is aligned with the wall of throat 158 that is formed by the upright wall 144 portion of the fluid discharge chamber 112, and the trailing discharge slot surface 154, which is formed in the trailing cover plate 146, is aligned with the wall of the throat 158 adjacent to the angled striker plate 114. Thus, cleaning fluid entering the fluid discharge chamber 112 must impact with the angled striker plate 114 whereby it is formed into a substantially uniform sheet of cleaning fluid before exiting the discharge chamber 112 through the discharge orifice 116 and the intervening throat 158, if present.

FIG. 9 is an bottom view of the bar jet assembly 122 showing the operational surface thereof and illustrating each of the two cover plates 146, 148 secured to the base plate 142 with one or more of the press-fit pins 138 and machined with one or more counter-sunk through holes 160 for securing the bar jet assembly 122 to the cleaning surface of the rotary cleaning plate 124 by one or more of the threaded fasteners 136. FIG. 9 also illustrates that, according to one embodiment of the invention, the portion of the discharge orifice 116 formed between the two cover plates 146, 148 extends the entire length of the bar jet assembly 122, while the portion of the discharge orifice 116 formed in the base plate 142 by the throat 158 is truncated at both ends before reaching the ends of the bar jet assembly 122.

Figure 10:
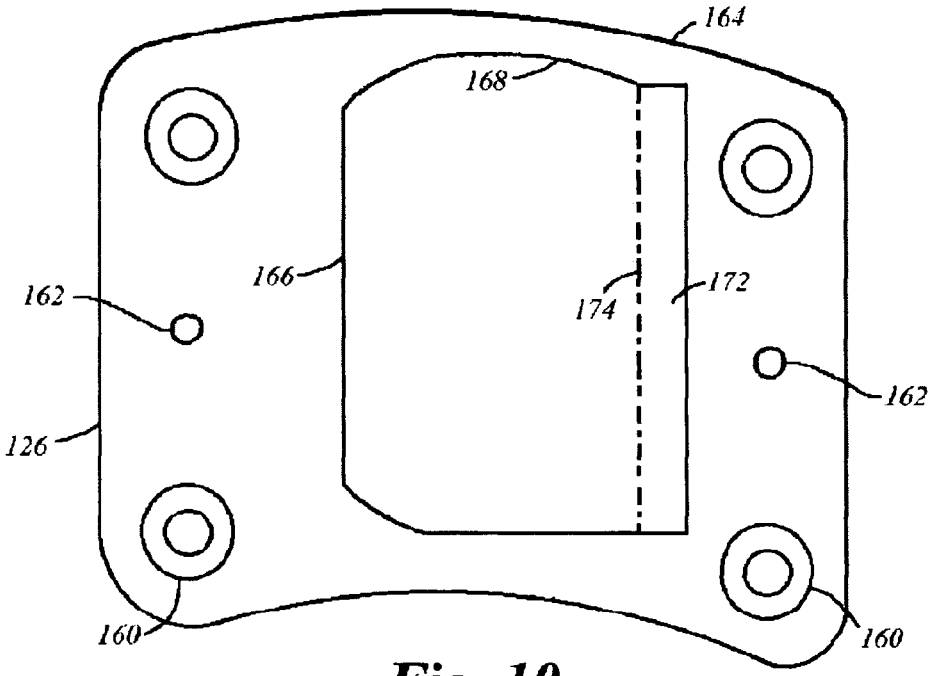
FIG. 10 is a plan view of a shoe member in which the bar jet assembly of the invention is optionally embedded or otherwise supported.

FIG. 10 is a plan view of the shoe 126 (shown in FIGS. 3, 5) in which the bar jet assembly 122 is optionally embedded or otherwise supported. The shoe 126 is embodied with one or more of the counter-sunk through holes 160 for securing it to the cleaning surface of the rotary cleaning plate 124 by one or more of the threaded fasteners 136, as illustrated in FIG. 5. As discussed herein, the shoe 126 may also includes one or more pin holes 162 each structured to accept one of the locating pins 138 for accurately positioning the shoe 126 relative to the rotary cleaning plate 124. An outer or peripheral edge 164 of the shoe 126 is optionally contoured to match the rotary cleaning plate 124 and as such can be located adjacent the peripheral edge of the rotary cleaning plate 124, as illustrated in FIG. 5. The shoe 126 is formed with an aperture 166 having an inner peripheral contour 168 matched to the outer peripheral contour 170 (shown in FIG. 9) of the bar jet assembly 122, except at an open edge portion 172 delineated by the phantom line 174. The open edge portion 172 is positioned to correspond to the retrieval slot or groove 120 in the rotary cleaning plate 124 adjacent to the cleaning head operating surface 118 opposite the discharge orifice 116. The open edge portion 172 thus operates as an extension to the rotary cleaning plate 124 that moves the operational cleaning surface toward the carpeting or other surface to be cleaned and thereby operates as a "skirt" to enhance the vacuum generated at the inlet to the retrieval slot 120 by shielding the slot 120 from the ambient environment. According to one embodiment of the invention, the delineation indicated by the phantom line 174 coincides with the cleaning fluid retrieval slot surface 123 of the bar jet assembly such that the open edge portion 172 is optionally sized substantially identically to the retrieval slot 120.

Figure 11:
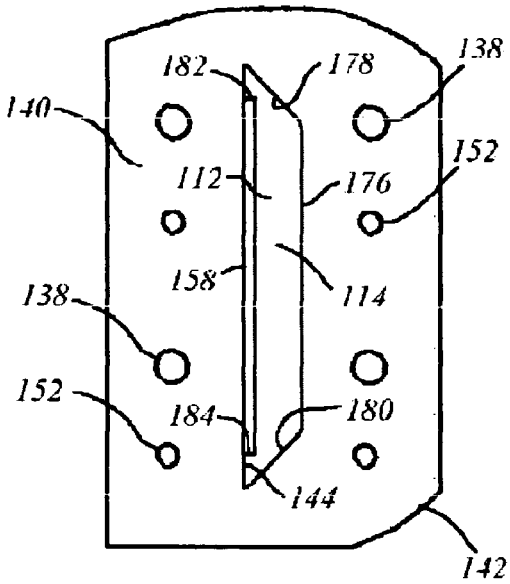
FIGS. 11 and 12 are top and bottom plan views, respectively, of a base plate portion of the bar jet assembly of the invention.
Figure 12:
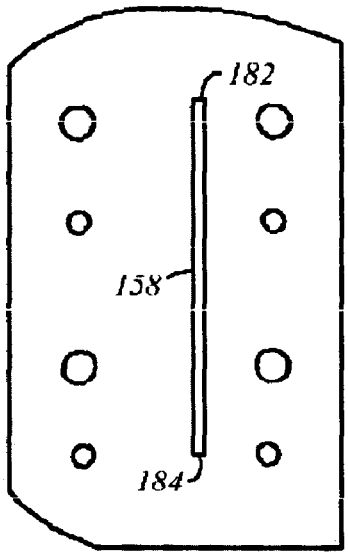

FIGS. 11 and 12 are top and bottom plan views, respectively, of the base plate 142 portion of the bar jet assembly 122. FIG. 11 illustrates the fluid discharge chamber 112 of the base plate 142 being formed between the upright wall 144 and an edge 176 where the angled striker plate 114 intersects the cleaning fluid input face 140 opposite from the throat 158 to the cleaning fluid output surface 150. The fluid discharge chamber 112 is bounded by end walls 178, 180 that communicate between the angled striker plate 114 and the cleaning fluid input face 140. As illustrated in both FIGS. 11 and 12, the throat 158 through which the cleaning fluid exits the discharge chamber 112 and enters the discharge orifice 116 is bounded on both ends opposing throat walls 182, 184.

According to one embodiment of the invention, the base plate 142 is embodied by example and without limitation in a sheet of aluminum or aluminum alloy for ease of machining, the material stock being about ⅛ inch thickness with overall outside dimensions of about 1 ⅜ inch to about 1 7/16 inch width by about 2 ¼ inch to about 2 ½ inch length.

Figure 13:
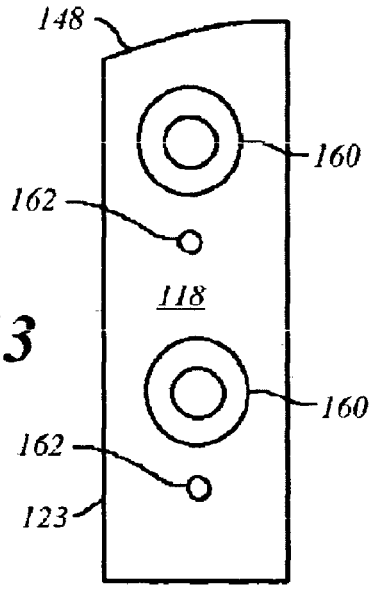
FIGS. 13 and 14 are plan and end views, respectively, of a forward or leading cover plate embodiment of the cleaning head surface of the invention.
Figure 14:
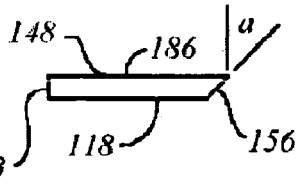

FIGS. 13 and 14 are plan and end views, respectively, of the forward cover plate 148 embodying the cleaning head operating surface 118. FIG. 14 particularly illustrates the leading discharge slot surface 156 which is aligned with the wall of throat 158 in the fluid discharge chamber 112. As discussed herein, the leading discharge slot surface 156 is oriented at an obtuse angle a of 45 degrees or more to a perpendicular to a substantially planar mounting surface 186 by which the forward cover plate 148 is mounted to the base plate 142 in the bare jet assembly 122. Stated differently, the leading discharge slot surface 156 is oriented at an angle of 135 degrees or more from the mounting surface 186.

Figure 17:
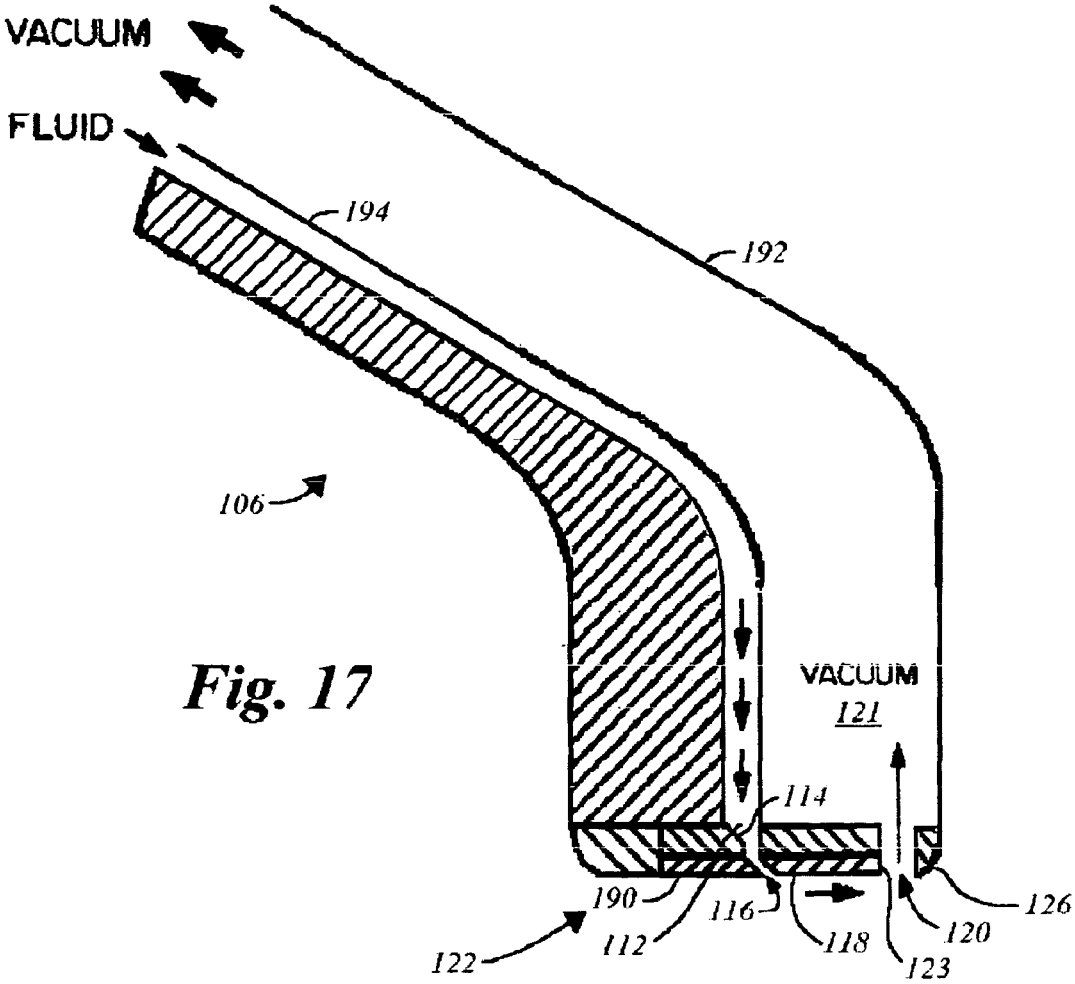
FIG. 17 illustrates one alternative embodiment of the invention wherein the cleaning head of the invention incorporates a single bar jet assembly of the invention in a hand-held nozzle.

Furthermore, the mounting surface 186 and the cleaning head operating surface 118 are spaced-apart and mutually parallel surfaces that are interconnected along one edge by the cleaning fluid retrieval slot surface 123 that is embodied as a substantially planar surface oriented to form a right angle with both the mounting surface 186 and the operating surface 118. The cleaning fluid retrieval slot surface 123 forms one portion of the cleaning fluid and soil retrieval slot or groove 120, as illustrated in FIGS. 3 and 17.

According to one embodiment of the invention, the forward cover plate 148 is embodied by example and without limitation in a sheet of corrosion resistant steel about 1/16 inch thickness with overall outside dimensions of about ⅝ inch to about ¾ inch width by about 2 ¼ inch to about 2 ½ inch length. The cleaning head operating surface 118 is provided with a very smooth finish such that carpeting and other materials and surfaces are not materially damaged by contact with the operating surface 118.

Figure 15:
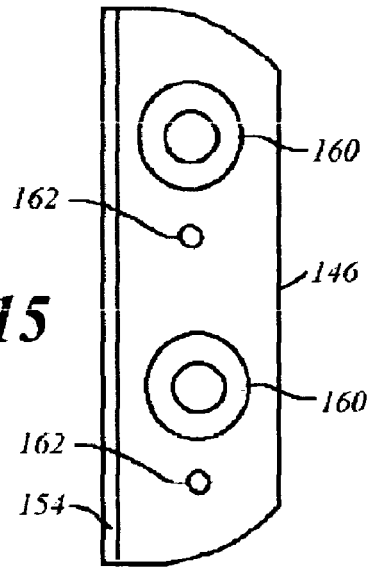
FIGS. 15 and 16 are plan and end views, respectively, of an aft or following cover plate embodiment of the cleaning head surface of the invention.
Figure 16:
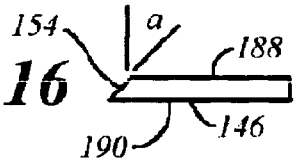

FIGS. 15 and 16 are plan and end views, respectively, of the aft or following cover plate 146 having the following discharge slot surface 154 embodied therein and oriented at substantially the same obtuse angle a of 45 degrees or more to a perpendicular to a substantially planar mounting surface 188 by which the following cover plate 146 is mounted to the base plate 142 in the bare jet assembly 122. The following cover plate 146 is also provided with a substantially planar skid surface 190 that is spaced away from and mutually parallel with the mounting surface 188. The cleaning head 106 rests on the skid surface 190 during operation for maintaining the head 106 parallel with the carpeting or other surface to be cleaned and for maintaining the vacuum at the cleaning fluid and soil retrieval slot 120.

According to one embodiment of the invention, the following cover plate 146 is embodied by example and without limitation in a sheet of corrosion resistant steel about 1/16 inch thickness with overall outside dimensions of about ¾ inch width by about 2 ¼ inch to about 2 ½ inch length. The cleaning head skid surface 190 is provided with a very smooth finish such that carpeting and other materials and surfaces are not materially damaged by contact with the skid surface 190.

FIGS. 13 and 15 also illustrate the plurality of pin holes 162 each structured to accept one of the locating pins 138 for accurately locating the respective leading and following cover plates 148, 146 on the base plate 142 and relative to one another such that the respective leading and following discharge slot surfaces 156, 154 are substantially parallel and spaced apart to form the narrow discharge orifice 116 described herein. The leading and following cover plates 148, 146 are also shown in FIGS. 13 and 15 to be formed with a plurality of the counter-sunk through holes 160 for securing the bar jet assembly 122 to the cleaning surface of the rotary cleaning plate 124 by one or more of the threaded fasteners 136 as discussed herein.

FIG. 17 illustrates one alternative embodiment of the cleaning head 106 of the invention wherein a single bar jet assembly 122 of the invention is coupled to a hand-held wand having a nozzle 192 having the half-funnel shaped cleaning fluid discharge chamber 112 coupled to the cleaning fluid source via a feed tube 194 for delivering liquid cleaning fluid. The feed tube 194 is structured for being coupled to the source of pressurized liquid cleaning fluid via the cleaning fluid delivery tube 110 (shown in FIG. 2). The cleaning fluid discharge chamber 112 again terminates in the angled striker plate 114 that is adjacent to the angled discharge slot or groove 116 opening onto one side of the cleaning head operating surface 118. Spaced away from the angled discharge orifice 116 across the expanse of the operating surface 118 is the cleaning fluid and soil retrieval slot or groove 120 formed in part by the cleaning fluid retrieval slot surface 123 and coupled to the vacuum chamber 121 that is constructed in the cleaning head 106. The vacuum chamber 121 is structured to be coupled to the cleaning system vacuum source via the vacuum hose 104. In operation, the alternative hand-held embodiment of the invention is as described herein.

Alternative Embodiments

Figure 18:
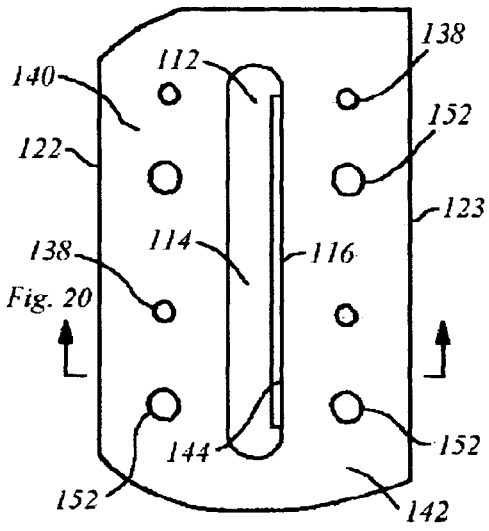
Figure 19:
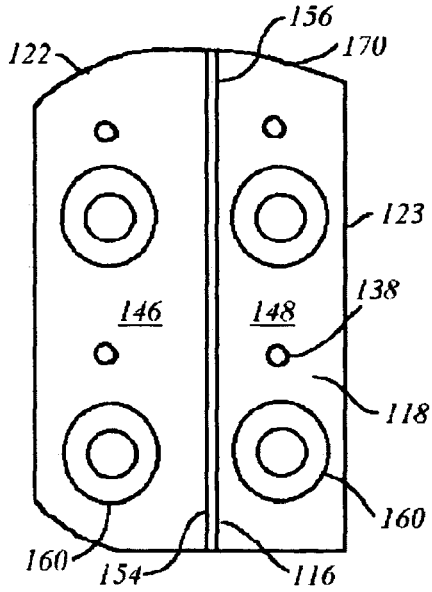
Figure 20:
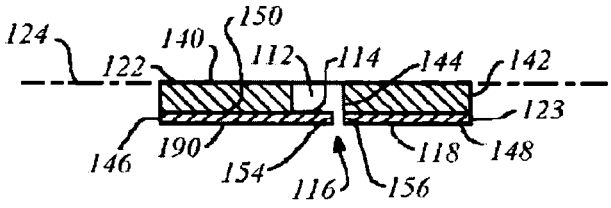

FIGS. 18, 19 and 20 illustrate one alternative embodiment of the bar jet assembly 122 of the invention, wherein FIG. 18 is a top plan view looking at the cleaning fluid input face 140 of the alternative bar jet assembly 122, FIG. 19 is a bottom plan view looking at the operational cleaning face of the alternative bar jet assembly 122, and FIG. 19 is a cross-sectional view of the alternative bar jet assembly 122 taken through the top plan view of FIG. 18. The cleaning fluid input face 140 of the bar jet assembly 122 is a planar surface embodied as the flat aluminum or aluminum alloy base plate 142 which is structured for mounting and sealing to the cleaning surface of the rotary cleaning plate 124 by the threaded fasteners 136 shown in FIG. 5. The cleaning fluid discharge chamber 112 is open and exposed for connection to the cleaning fluid distribution channel 134 of the distribution manifold 132 shown in FIG. 4. As embodied in FIG. 18, the cleaning fluid discharge chamber 112 is a box-shaped space formed by a substantially rectangular aperture in the base plate 142 and substantially closed on its output surface by the striker plate 114 formed substantially perpendicular to the cleaning fluid input face 140 such that the cleaning fluid discharge chamber 112 is shown in FIG. 20 to have a substantially rectangular cross-section. The throat 158 of the discharge chamber 112 is eliminated with the discharge orifice 116 opening onto the cleaning head operating surface 118 along one edge adjacent to the upright wall 144 (shown in FIGS. 19, 20), such that the discharge orifice 116 communicates directly between the fluid discharge chamber 112 and the operating surface 118. Accordingly, the discharge orifice 116 is a formed between the machined surfaces 154, 156 (shown more clearly in FIGS. 21, 22) of the two cover plates 146, 148, with the discharge orifice 116 being provided substantially crosswise or perpendicular to the fluid input face 140 of the bar jet assembly 122.

On either side of the cleaning fluid discharge chamber 112 one or more of the more locating pins 138 are provided for locating the pair of corrosion resistant or stainless steel cover plates 146, 148 (shown in FIGS. 19, 20) of the bar jet assembly 122 relative to the cleaning fluid output surface 150 of the base plate 142 which has the cleaning fluid discharge chamber 112 formed therein. One or more of the fastener through holes 152 are machined in the base plate 142 on either side of the cleaning fluid discharge chamber 112 for securing the bar jet assembly 122 to the cleaning surface of the rotary cleaning plate 124 by one or more of the threaded fasteners 136.

The two surfaces 154, 156 of the discharge orifice 116 are both upright or even perpendicular relative to the cleaning surface of the rotary cleaning plate 124 (shown in phantom). While effectiveness of the cleaning head 106 in reducing cleaning fluid penetration is enhanced when the discharge orifice 116 is closer to parallel with the cleaning surface of the rotary cleaning plate 124, the cleaning head 106 is alternatively oriented perpendicular thereto. The two discharge slot surfaces 154, 156 are oriented substantially parallel to one another and spaced only a short distance apart so that the discharge orifice 116 is very narrow, as discussed herein.

The cleaning fluid retrieval slot surface 123 is a substantially planar surface that is oriented to form a right angle with cleaning head operating surface 118.

FIG. 19 is an bottom view of the bar jet assembly 122 showing the operational surface thereof and illustrating each of the two cover plates 146, 148 secured to the base plate 142 with one or more of the press-fit pins 138 and machined with one or more of the counter-sunk through holes 160 for securing the bar jet assembly 122 to the cleaning surface of the rotary cleaning plate 124 by one or more of the threaded fasteners 136. FIG. 19 also illustrates that, according to one embodiment of the invention, the portion of the discharge orifice 116 formed between the two cover plates 146, 148 extends the entire length of the bar jet assembly 122, while the discharge chamber 112 is truncated at both ends without extending to the ends of the bar jet assembly 122.

FIG. 20 is the cross-sectional view taken through the top plan view of FIG. 18 and illustrates the fluid discharge chamber 112 being formed of the crosswise striker plate 114 and the upright wall 144 and terminating in the upright discharge orifice 116. As illustrated in FIG. 20, the leading discharge slot surface 156, which is formed in the leading cover plate 148, is aligned with the upright wall 144 portion of the fluid discharge chamber 112, and the trailing discharge slot surface 154, which is formed in the trailing cover plate 146, is spaced behind the leading discharge slot surface 156. Thus, cleaning fluid entering the fluid discharge chamber 112 must impact with the striker plate 114 before exiting the discharge chamber 112 through the discharge orifice 116 under pressure.

Figure 21:
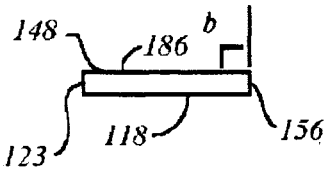
FIGS. 21 and 22 are end views, respectively, of the forward or leading cover plate and the aft or following cover plate according to the alternative embodiment of the invention illustrated in FIGS. 18, 19, 20.
Figure 22:
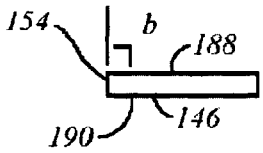

FIGS. 21 and 22 are end views, respectively, of the forward or leading cover plate 148 and the aft or following cover plate 146 according to the alternative embodiment of the invention illustrated in FIGS. 18, 19, 20. Accordingly, the leading discharge slot surface 156 of the leading cover plate 148 is illustrated in FIG. 21 as being oriented at a substantially right angle b or perpendicular to the substantially planar mounting surface 186 by which the forward cover plate 148 is mounted to the base plate 142 in the bare jet assembly 122. Stated differently, the leading discharge slot surface 156 is oriented at an angle of about 90 degrees from the mounting surface 186. The cleaning fluid retrieval slot surface 123 that forms one portion of the cleaning fluid and soil retrieval slot or groove 120 (shown FIGS. 3, 17) is embodied as the substantially planar surface oriented to form a right angle with both the mounting surface 186 and the operating surface 118.

FIG. 22 illustrates the following discharge slot surface 154 of the following cover plate 146 as being oriented at the substantially right angle b or perpendicular to the substantially planar mounting surface 188 by which the following cover plate 146 is mounted to the base plate 142 in the bare jet assembly 122. Stated differently, the following discharge slot surface 154 is oriented at an angle of about 90 degrees from the mounting surface 188. The following cover plate 146 is also provided with the substantially planar skid surface 190 that is spaced away from and mutually parallel with the mounting surface 188. As discussed herein, the cleaning head 106 rests on the skid surface 190 during operation for maintaining the head 106 parallel with the carpeting or other surface to be cleaned and for maintaining the vacuum at the cleaning fluid and soil retrieval slot 120.

Figure 23:
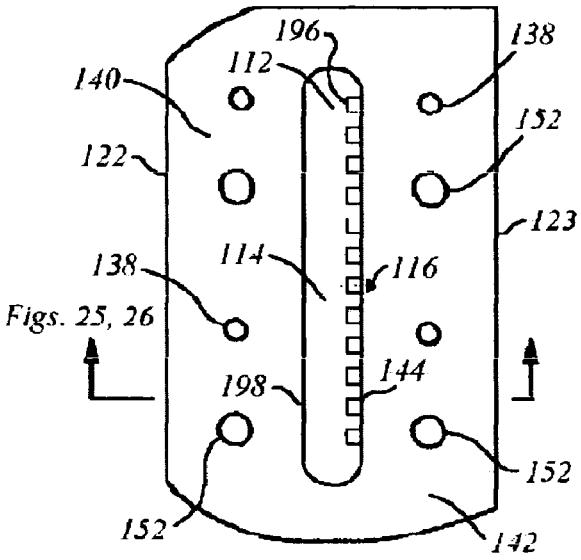
Figure 24:
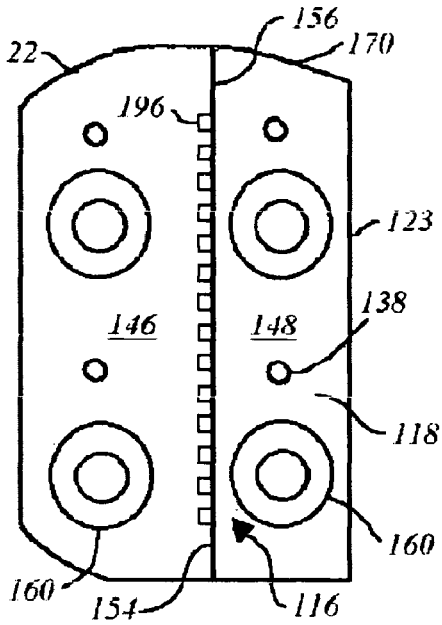
Figure 25:
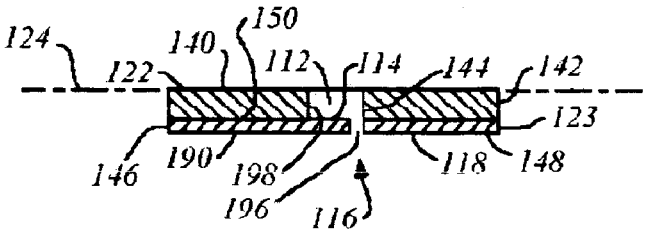
Figure 26:
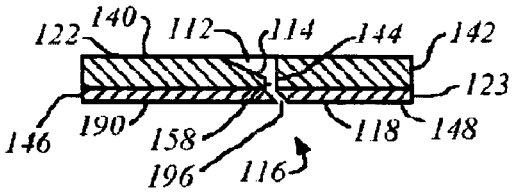

FIGS. 23, 24, 25 and 26 illustrate another alternative embodiment of the bar jet assembly 122 of the invention, wherein FIG. 23 is a top plan view looking at the cleaning fluid input face 140 of the alternative bar jet assembly 122, FIG. 24 is a bottom plan view looking at the operational cleaning face of the alternative bar jet assembly 122, and FIGS. 25 and 26 are alternative cross-sectional views of the alternative bar jet assembly 122 taken through the top plan view of FIG. 23. In the embodiment of FIGS. 23, 24 and 25 the discharge orifice 116 is embodied as a substantially linear pattern of multiple discharge slots 196 formed, by example and without limitation, as a line of discharge slots 196 communicating between one the discharge chamber 112 and the operating surface 118. The multiple discharge slots 196 are cut about 8 to 10 thousands of an inch or less deep such that each discharge slot 196 is on the order of about 0.008 inch to 0.010 inch or less in depth. However, discharge slots 196 alternatively cut 0.010 inch to about 0.017 inch in depth or even as much as 0.020 inch in depth are also effective for forming the uniform sheet of liquid cleaning fluid according to the invention. The depth of the discharge slots 196 is limited to the degree that sufficient back pressure is developed in the discharge chamber 112 so that the cleaning fluid is discharge from the accumulated slots 196 under pressure, rather than flowing freely from the discharge slots 196. The length of the discharge slots 196 as measured along the discharge slot surfaces 154, 156 can be varied from the minimum slot width of about 0.008 inch to as much as the entire length of the discharge chamber 112, without materially affecting the practice of the invention. Spacing between the individual discharge slots 196 can be varied from very close to widely spaced, without materially affecting the practice of the invention, as long as sufficient liquid cleaning fluid volume is discharged through the discharge slots 196 to form a substantially uniform sheet of liquid across a major portion of the operating surface 118 of the leading cover plate 148.

By example and without limitation, the discharge slots 196 are formed along the leading edge of the discharge chamber 112 adjacent to the leading upright wall 144. However, the pattern of discharge holes 196 is alternatively formed adjacent a trailing edge 198 of the discharge chamber 112, or alternatively, between the leading and trailing edges 144, 198 without materially affecting the practice of the invention. The pattern of discharge slots 196 is formed, by example and without limitation, spaced apart as by comb teeth along the leading edge 154 of the trailing or following cover plate 146, or alternatively, along the trailing edge 156 of the leading cover plate 148.

In the embodiment of FIG. 25 the pattern of discharge slots 196 that form the discharge orifice 116 are formed crosswise or substantially perpendicular to the operating surface 118 as described in connection with the embodiment of FIGS. 18–22. In the alternative embodiment illustrated in FIG. 26 the pattern of discharge slots 196 that form the discharge orifice 116 are formed at angle to the operating surface 118 as described in connection with the embodiment of FIGS. 6–9.

In the embodiment of FIGS. 23, 24, 25 and 26 the cleaning fluid discharge chamber 112 is substantially closed on its output surface by the striker plate 114 which is either the angled striker plate illustrated in FIG. 3, or the crosswise striker plate illustrated in FIG. 20, without materially affecting the practice of the invention.

Figure 28:
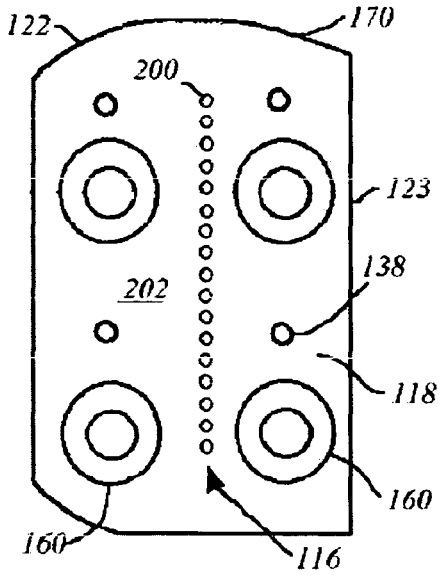
Figure 29:
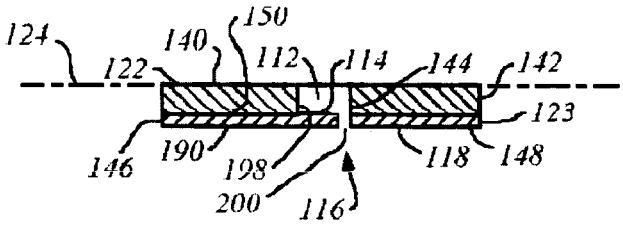
Figure 30:
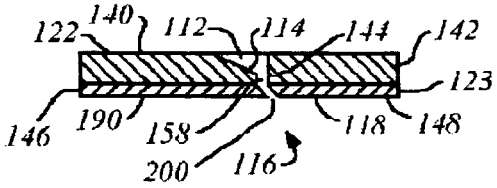

FIGS. 27, 28, 29 and 30 illustrate another alternative embodiment of the bar jet assembly 122 of the invention, wherein FIG. 27 is a top plan view looking at the cleaning fluid input face 140 of the alternative bar jet assembly 122, FIG. 28 is a bottom plan view looking at the operational cleaning face of the alternative bar jet assembly 122, and FIGS. 29 and 30 are alternative cross-sectional views of the alternative bar jet assembly 122 taken through the top plan view of FIG. 27. In the embodiment of FIGS. 27, 28, 29 and 30 the discharge orifice 116 is embodied as a substantially linear pattern of discharge apertures or holes 200 formed, by example and without limitation, as a line of substantially round discharge holes 200 communicating as by drilling between one the discharge chamber 112 and the operating surface 118. By example and without limitation, the discharge holes 200 are formed along the leading edge of the discharge chamber 112 adjacent to the leading upright wall 144. However, the pattern of discharge holes 196 is alternatively formed adjacent the trailing edge 198 of the discharge chamber 112, or alternatively, between the leading and trailing edges 144, 198 without materially affecting the practice of the invention. The discharge holes 200 are sized to discharge a sufficient liquid cleaning fluid volume through the pattern of discharge holes 200 to form a substantially uniform sheet of liquid across a major portion of the operating surface 118. The multiple discharge holes 200 are about 8 to 10 thousands of an inch or less in diameter. However, discharge holes 200 alternatively made 0.010 inch to about 0.017 inch in diameter or even as much as 0.020 inch diameter are also effective for forming the uniform sheet of liquid cleaning fluid according to the invention. The diameter of the discharge holes 200 is limited to the degree that sufficient back pressure is developed in the discharge chamber 112 so that the cleaning fluid is discharge from the accumulated holes 200 under pressure, rather than flowing freely from the discharge holes 200. The length of the pattern of discharge holes 200 is optionally as much as the entire length of the discharge chamber 112. Spacing between adjacent holes 200 can be varied from very close to widely spaced, without materially affecting the practice of the invention, as long as sufficient liquid cleaning fluid volume is discharged through the discharge slots 196 to form a substantially uniform sheet of liquid across a major portion of the operating surface 118.

The pattern of discharge holes 200 forming the discharge orifice 116 is formed in the leading edge 154 of the trailing or following cover plate 146, or alternatively, along the trailing edge 156 of the leading cover plate 148.

According to one embodiment of the invention, the pair of leading and trailing cover plates 146, 148 is replaced with a single corrosion resistant or stainless steel cover plate 202, as illustrated in FIG. 28, having formed therethrough the pattern of discharge holes 200 forming the discharge orifice 116 of the invention.

In the embodiment of FIG. 29 the pattern of discharge holes 200 that form the discharge orifice 116 are formed crosswise or substantially perpendicular to the operating surface 118 as described in connection with the embodiment of FIGS. 18–22. In the alternative embodiment illustrated in FIG. 30 the pattern of discharge holes 200 that form the discharge orifice 116 are formed at angle to the operating surface 118 as described in connection with the embodiment of FIGS. 6–9.

In the embodiment of FIGS. 27, 28, 29 and 30 the cleaning fluid discharge chamber 112 is substantially closed on its output surface by the striker plate 114 which is either the angled striker plate illustrated in FIG. 3, or the crosswise striker plate illustrated in FIG. 20, without materially affecting the practice of the invention.

While the preferred embodiment of the invention has been illustrated and described, it will be appreciated that various changes can be made therein without departing from the spirit and scope of the invention.

What is claimed is:

1. A bar jet assembly, comprising:

a base plate having opposing cleaning fluid input and output surfaces and an elongated cleaning fluid discharge chamber communicating therebetween;

one or more cover plates coupled to the fluid output surface of the base plate;

a cleaning fluid discharge orifice formed by the one or more cover plates and communicating with the base plate discharge chamber;

a cleaning head operating surface formed opposite from the base plate and adjacent to the cleaning fluid discharge orifice; and a cleaning fluid retrieval slot surface formed by the one or more cover plates and being spaced apart from the cleaning fluid discharge orifice by the cleaning head operating surface.

2. The bar jet assembly of claim 1 wherein the one or more cover plates further comprises a pair of cover plates.

3. The bar jet assembly of claim 1 wherein the cleaning fluid discharge orifice formed by the one or more cover plates further comprises a cleaning fluid discharge orifice that is inclined relative to the cleaning head operating surface.

4. The bar jet assembly of claim 3 wherein the inclined cleaning fluid discharge slot further comprises a slot formed between a pair of cover plates and oriented to the cleaning head operating surface at an obtuse angle.

5. The bar jet assembly of claim 1 wherein the one or more cover plates further comprises a substantially planar skid surface on an opposite side of the cleaning fluid discharge orifice from the operating surface.

6. The bar jet assembly of claim 1 wherein the elongated cleaning fluid discharge chamber further comprises a substantially triangular cross-section having a base formed by an elongated opening in communication with the base plate fluid input surface and having an apex formed by an elongated discharge slot in communication with the base plate fluid output surface.

7. The bar jet assembly of claim 6 wherein the elongated triangular discharge chamber in the base plate further comprises a right triangular cross-section having an upright wall oriented crosswise to the fluid input surface and extending between the fluid input surface and the discharge slot in the cleaning fluid output surface.

8. The bar jet assembly of claim 7 wherein the elongated triangular chamber further comprises an inclined cleaning fluid striker plate oriented at an angle to the base plate fluid input surface and communicating between the base plate fluid input surface and the base plate discharge slot opposite from the upright wall.

9. The bar jet assembly of claim 8 wherein the base plate further comprises an elongated throat communicating between the base plate cleaning fluid discharge chamber and the cleaning fluid output surface.

10. The bar jet assembly of claim 1 wherein the cleaning fluid discharge orifice further comprises a plurality of discharge orifices.

11. The bar jet assembly of claim 10 wherein the plurality of discharge orifices further comprises a substantially linear pattern of discharge orifices.

12. The bar jet assembly of claim 11 wherein each of the plurality of discharge orifices further comprises a substantially rectangular slot.

13. The bar jet assembly of claim 11 wherein each of the plurality of discharge orifices further comprises a substantially round aperture.

14. A bar jet assembly, comprising:

a base plate having spaced apart input and output surfaces interconnected by a peripheral edge surface oriented crosswise to the input and output surfaces and an elongated cleaning fluid discharge chamber in communication with the input surface and terminating in an elongated base plate discharge slot communicating with the fluid output surface;

one or more relatively thin cover plates secured to the fluid output surface of the base plate and forming a cleaning fluid discharge orifice in communication with the cleaning fluid discharge chamber through the base plate discharge slot, the one or more cover plates having a cleaning fluid retrieval slot surface spaced apart from the cleaning fluid discharge orifice by a substantially planar cleaning head operating surface.

15. The bar jet assembly of claim 14 wherein the cleaning fluid discharge orifice forms an obtuse angle with the cleaning head operating surface.

16. The bar jet assembly of claim 14 wherein the cleaning fluid retrieval slot surface is further oriented substantially crosswise to the cleaning head operating surface.

17. The bar jet assembly of claim 14 wherein the cleaning fluid discharge chamber further comprises an inclined striker plate forming an angle with the input surface of the base plate.

18. The bar jet assembly of claim 17 wherein the angle formed by the inclined striker plate with the input surface of the base plate further comprises an acute angle.

19. The bar jet assembly of claim 14 wherein the cleaning fluid discharge orifice further comprises one or more substantially round holes.

20. The bar jet assembly of claim 14 wherein the cleaning fluid discharge orifice further comprises one or more slots.

21. The bar jet assembly of claim 20 wherein the one or more relatively thin cover plates further comprises a substantially coplanar pair of cover plates having the one or more slots formed therebetween.

22. The bar jet assembly of claim 21, further comprising an elongated throat communicating between the elongated triangular chamber and the base plate fluid output surface.

23. A bar jet assembly, comprising:

a substantially flat base plate having spaced apart substantially parallel and planar input and output surfaces interconnected by a substantially planar peripheral edge surface oriented crosswise to the input and output surfaces and an elongated cleaning fluid discharge chamber in communication with both the input and output surfaces, the discharge chamber having a relatively long and wide opening in communication with the fluid input surface and terminating adjacent to one side of the chamber in a relatively shorter and narrower discharge slot that is in communication with the fluid output surface;

a leading cover plate having spaced apart and substantially parallel planar mounting and operating surfaces that are interconnected along a first edge by a substantially planar cleaning fluid retrieval slot surface that is oriented crosswise to both the mounting and operating surfaces and along an opposite second edge by a substantially planar discharge slot leading surface, the mounting surface of the leading cover plate being securely fixed to the output surface of the base plate with the discharge slot leading surface being adjacent to and substantially contiguous with an edge of the base plate discharge slot opposite from the discharge chamber of the base plate, and the retrieval slot surface being adjacent to and substantially contiguous with the crosswise peripheral edge surface of the base plate; and a following cover plate having spaced apart and substantially parallel planar mounting and skid surfaces that are interconnected along a first edge by a substantially planar discharge slot following surface, the mounting surface of the following cover plate being securely fixed to the output surface of the base plate with the discharge slot following surface adjacent to and substantially contiguous with an edge of the base plate discharge slot opposite from the leading cover plate and spaced away from the discharge slot leading surface of the leading cover plate.

24. The bar jet assembly of claim 23 wherein the discharge slot leading surface is inclined relative to the leading cover plate operating surface, and the discharge slot following surface is inclined relative to the following cover plate skid surface.

25. The bar jet assembly of claim 23 wherein the discharge slot following surface of the following cover plate is spaced away from the discharge slot leading surface of the leading cover plate by approximately 0.020 inch or less.

26. The bar jet assembly of claim 23 wherein the cleaning fluid discharge chamber is formed in the base plate having an inclined striker plate adjacent to the discharge slot.

27. The bar jet assembly of claim 26 wherein the striker plate further comprises a substantially planar surface having a first elongated edge that intersects the cleaning fluid input surface of the base plate, and a second elongated edge that intersects a first side of the discharge slot adjacent to the fluid output surface.

28. The bar jet assembly of claim 27 wherein the cleaning fluid discharge chamber further comprises an elongated upright wall oriented crosswise to the cleaning fluid input and output surfaces of the base plate and extending between the cleaning fluid input surface of the base plate and a second side of the discharge slot adjacent to the fluid output surface and opposite from the striker plate.

29. The bar jet assembly of claim 23 wherein the discharge slot in the base plate further comprises a narrow elongated throat communicating between the discharge chamber and the output surface of the base plate.

30. A cleaning head, comprising:

a bar jet assembly, comprising:

i) a base plate having opposing cleaning fluid input and output surfaces and a cleaning fluid discharge chamber communicating therebetween, ii) one or more cover plates coupled to the fluid output surface of the base plate, iii) a cleaning fluid discharge orifice formed by the one or more cover plates and communicating with the base plate discharge slot, iv) a cleaning head operating surface formed opposite from the base plate and adjacent to the cleaning fluid discharge orifice, and v) a cleaning fluid retrieval slot surface spaced apart from the cleaning fluid discharge orifice by the cleaning head operating surface; and a nozzle that is structured for coupling the cleaning fluid discharge chamber of the bar jet assembly base plate to a supply of pressurized cleaning fluid, and that is structured for coupling the waste cleaning fluid retrieval slot surface to a vacuum source for retrieving a quantity of soiled cleaning fluid under vacuum.

31. The cleaning head of claim 30 wherein the cleaning head operating surface further comprises a substantially planar operating surface formed between the cleaning fluid discharge orifice and the cleaning fluid retrieval slot surface.

32. The cleaning head of claim 31 wherein the bar jet assembly further comprises a skid surface adjacent to the cleaning fluid discharge slot.

33. The cleaning head of claim 30 wherein the cleaning fluid discharge orifice further comprises a cleaning fluid discharge orifice that is inclined relative to the cleaning head operating surface.

34. The cleaning head of claim 33 wherein the cleaning fluid discharge orifice further comprises an elongated discharge slot formed between a pair of cover plates coupled to the fluid output surface of the base plate.

35. The cleaning head of claim 30 wherein the nozzle further comprises a rotary cleaning plate having a means for coupling the cleaning fluid discharge chamber of the bar jet assembly base plate to the supply of pressurized cleaning fluid, and a means for coupling the waste cleaning fluid retrieval slot surface to the vacuum source.

36. The cleaning head of claim 35, further comprising a plurality of the bar jet assemblies distributed across the rotary cleaning plate, and wherein the rotary cleaning plate further comprises means for coupling the cleaning fluid discharge chamber of each of the bar jet assembly base plates to the supply of pressurized cleaning fluid, and a means for coupling the waste cleaning fluid retrieval slot surface of each of the bar jet assemblies to the vacuum source.

37. The cleaning head of claim 36 wherein the means for coupling the cleaning fluid discharge chamber of each of the bar jet assembly base plates to the supply of pressurized cleaning fluid means for delivering the pressurized cleaning fluid to each of the bar jet assemblies at a pressure reduced relative to a pressure at which the cleaning fluid is delivered to the cleaning head.

38. The cleaning head of claim 37 wherein the means for delivering the pressurized cleaning fluid to the bar jet assemblies at a relatively reduced pressure further comprises an expansion chamber.

39. A cleaning head, comprising:

a bar jet assembly, comprising:

i) a base plate having spaced apart input and output surfaces interconnected by a peripheral edge surface oriented crosswise to the input and output surfaces and an elongated cleaning fluid discharge chamber in communication with the input surface and terminating in an elongated base plate discharge slot communicating with the fluid output surface, and ii) one or more relatively thin cover plates secured to the fluid output surface of the base plate and forming a cleaning fluid discharge orifice in communication with the cleaning fluid discharge chamber through the base plate discharge slot, the one or more cover plates having a cleaning fluid retrieval slot surface spaced apart from the cleaning fluid discharge orifice by a substantially planar cleaning head operating surface; and a nozzle coupled to the bar jet assembly, the cleaning head being structured for coupling a source of pressurized cleaning fluid to the bar jet assembly cleaning fluid discharge chamber, and being further structured for coupling a vacuum source in communication with the bar jet assembly cleaning fluid retrieval slot surface.

40. The cleaning head of claim 39 wherein the cleaning fluid discharge orifice is oriented substantially crosswise to the cleaning head operating surface.

41. The cleaning head of claim 40 wherein the cleaning fluid discharge orifice further comprises a plurality of cleaning fluid discharge orifices arranged in a pattern.

42. The cleaning head of claim 41 wherein the pattern of cleaning fluid discharge orifices further comprises a linear pattern.

43. The cleaning head of claim 39 wherein the cleaning fluid discharge orifice forms an angle with the cleaning head operating surface.

44. The cleaning head of claim 43 wherein the one or more cover plates further comprises a pair of cover plates, and the cleaning fluid discharge orifice further comprises an elongated slot formed between the pair of cover plates.

45. The cleaning head of claim 39 wherein the nozzle further comprises a rotary cleaning head structured for rotation and having one or more of the bar jet assemblies distributed across a rotatable surface thereof.

46. The cleaning head of claim 45 wherein the rotary cleaning head further comprises a cleaning fluid distribution manifold structured to deliver cleaning fluid to each of the one or more bar jet assemblies.

47. The cleaning head of claim 46 wherein the cleaning fluid distribution manifold further comprises an inlet structured for receiving pressurized cleaning fluid, and wherein the cleaning fluid distribution manifold is further structured to operate as an expansion chamber for reducing an inlet pressure of the pressurized cleaning fluid.

48. A cleaning head, comprising:

a bar jet assembly, comprising:

i) a substantially flat base plate having spaced apart substantially parallel and planar input and output surfaces interconnected by a substantially planar peripheral edge surface oriented crosswise to the input and output surfaces and an elongated cleaning fluid discharge chamber in communication with both the input and output surfaces, the discharge chamber having a relatively long and wide opening in communication with the fluid input surface and terminating adjacent to one side of the chamber in a relatively shorter and narrower discharge slot that is in communication with the fluid output surface;

ii) a leading cover plate having spaced apart and substantially parallel planar mounting and operating surfaces that are interconnected along a first edge by a substantially planar cleaning fluid retrieval slot surface that is oriented crosswise to both the mounting and operating surfaces and along an opposite second edge by a substantially planar discharge slot leading surface, the mounting surface of the leading cover plate being securely fixed to the output surface of the base plate with the discharge slot leading surface being adjacent to and substantially contiguous with an edge of the base plate discharge slot opposite from the discharge chamber of the base plate, and the retrieval slot surface being adjacent to and substantially contiguous with the crosswise peripheral edge surface of the base plate; and iii) a following cover plate having spaced apart and substantially parallel planar mounting and skid surfaces that are interconnected along a first edge by a substantially planar discharge slot following surface, the mounting surface of the following cover plate being securely fixed to the output surface of the base plate with the discharge slot following surface adjacent to and substantially contiguous with an edge of the base plate discharge slot opposite from the leading cover plate and spaced away from the discharge slot leading surface of the leading cover plate; and a rotary cleaning plate having a cleaning fluid and soil retrieval slot machined therethrough and being structured for being coupled to a vacuum source, and a corresponding cleaning fluid delivery slot machined therethrough and being structured for being coupled to a source of pressurized cleaning fluid; and wherein the input surface of the bar jet assembly base plate is coupled to the rotary cleaning plate with the cleaning fluid discharge chamber being in communication with the cleaning fluid delivery slot and the crosswise-oriented peripheral edge surface being in communication with the corresponding cleaning fluid and soil retrieval slot.

49. The cleaning head of claim 48 wherein the discharge slot leading and following surfaces are mutually spaced apart by approximately 0.020 inch or less.

50. The cleaning head of claim 49 wherein the discharge slot leading and following surfaces are mutually inclined relative to the leading cover plate operating surface.

51. The cleaning head of claim 49 wherein the discharge slot leading and following surfaces are oriented substantially crosswise to the leading cover plate operating surface.

52. The cleaning head of claim 48 wherein the rotary cleaning plate further comprises a uniformly distributed plurality of both the cleaning fluid and soil retrieval slots and the corresponding cleaning fluid delivery slots, and further comprising a plurality of the bar jet assemblies, with one of the bar jet assemblies being coupled with the cleaning fluid discharge chamber being in communication with the cleaning fluid delivery slot and the crosswise-oriented peripheral edge surface being in communication with the corresponding cleaning fluid and soil retrieval slot.

53. The cleaning head of claim 52, further comprising a cleaning fluid distribution manifold coupled between each of the bar jet assemblies and the source of pressurized cleaning fluid, the cleaning fluid distribution manifold being structured to operate as an expansion chamber for reducing the pressure of the cleaning fluid to below a delivery pressure provided by the source of pressurized cleaning fluid.

54. The cleaning head of claim 52, further comprising a plurality of stabilizer members distributed intermittent the plurality of bar jet assemblies.

55. A method for cleaning a surface, the method comprising:

placing a cleaning head operating surface area in contact with a surface to be cleaned;

applying a cleaning liquid to the surface to be cleaned by flowing the cleaning liquid out of a cleaning fluid discharge chamber formed in a base plate and communicating with a fluid output surface thereof, through a cleaning fluid discharge orifice communicating with the base plate discharge chamber and formed by one or more cover plates coupled to the fluid output surface of the base plate, and in substantially continuous film over a portion of the cleaning head operating surface area formed opposite from the base plate and adjacent to the cleaning fluid discharge orifice; and retrieving the cleaning liquid via a vacuum retrieval slot formed by the one or more cover plates and being spaced apart from the cleaning fluid discharge orifice by the cleaning head operating surface.

56. The method of claim 55 wherein flowing the cleaning liquid through a cleaning fluid discharge orifice further comprises flowing the cleaning liquid at an angle to the surface to be cleaned.

57. The method of claim 55 wherein flowing the cleaning liquid through a cleaning fluid discharge orifice further comprises flowing the cleaning liquid through a plurality of cleaning fluid discharge orifices.

58. The method of claim 55 wherein placing a surface contact area in contact with a surface to be cleaned further comprises placing an operating surface of a cleaning tool in contact with a surface to be cleaned.

59. The method of claim 58 wherein placing a surface contact area in contact with a surface to be cleaned further comprises placing the cleaning fluid discharge orifice and operating surface in contact with a surface to be cleaned.

60. The method of claim 58 wherein placing a surface contact area in contact with a surface to be cleaned further comprises outlining limits of operation of the tool.

61. The method of claim 58, further comprising: interconnecting the cleaning tool and a source of cleaning fluid.

62. The method of claim 61, further comprising: interconnecting the cleaning tool and a source of vacuum.

* * * * *